United States Patent [19]

Michaud et al.

[11] 4,319,873

[45] Mar. 16, 1982

[54] FLAME DETECTION AND PROOF CONTROL DEVICE

[75] Inventors: Roger P. Michaud, Lewiston, Me.; Douglas B. Campbell, deceased, late of Gilford, N.H., by Diane Campbell, administratrix

[73] Assignee: American Stabilis, Inc., Lewiston, Me.

[21] Appl. No.: 29,572

[22] Filed: Apr. 12, 1979

[51] Int. Cl.[3] ..... F23N 5/00

[52] U.S. Cl. ..... 431/24; 431/69

[58] Field of Search ..... 431/69, 71, 73, 74, 431/24, 25; 307/117; 340/577-579

[56] References Cited

U.S. PATENT DOCUMENTS

| | | | |
|---|---|---|---|
| 2,403,411 | 7/1946 | Strobel | 431/71 |
| 2,981,324 | 4/1961 | Deziel . | |
| 3,115,180 | 12/1963 | Deubel . | |
| 3,155,145 | 11/1964 | La Pointe et al. . | |
| 3,223,138 | 12/1965 | Brown . | |
| 3,263,731 | 8/1966 | Hanna et al. . | |
| 3,266,551 | 8/1966 | Giuffrida . | |
| 3,376,099 | 4/1968 | Giuffrida et al. | 431/26 |
| 3,405,998 | 10/1968 | Walbridge | 431/25 |
| 3,447,880 | 6/1969 | Potts et al. | 431/27 |
| 3,449,055 | 6/1969 | Blackett | 431/26 |
| 3,614,280 | 10/1971 | Tamio | 431/78 |
| 3,644,074 | 2/1972 | Cade | 431/26 |
| 3,671,169 | 6/1972 | Hron et al. | 431/67 |
| 3,705,783 | 12/1972 | Warren | 431/46 |
| 3,727,073 | 4/1973 | Cade | 307/117 |
| 3,732,433 | 5/1973 | Lourigan | 307/117 |
| 3,801,800 | 4/1974 | Newton | 307/117 |
| 3,816,053 | 6/1974 | Cade | 431/78 |
| 3,830,619 | 8/1974 | Cade | 431/78 |
| 3,840,322 | 10/1974 | Cade | 431/78 |
| 3,852,729 | 12/1974 | Cade | 431/79 |
| 3,854,056 | 12/1974 | Cade | 307/117 |
| 3,872,320 | 3/1975 | Juskewicz | 307/117 |
| 3,892,981 | 7/1975 | Bauer | 307/117 |
| 3,895,241 | 7/1975 | Cooper | 307/311 |
| 3,905,748 | 9/1975 | Cairo et al. | 431/78 |
| 3,918,881 | 11/1975 | Matthews | 431/46 |
| 3,930,783 | 1/1976 | Bauer | 431/78 |
| 3,935,473 | 1/1976 | Bauer et al. | 307/117 |
| 3,975,136 | 8/1976 | Baysinger et al. | 431/74 |
| 4,000,961 | 1/1977 | Mandock | 431/2 |
| 4,025,283 | 5/1977 | Ray | 431/45 |
| 4,073,611 | 2/1978 | Kaduki et al. | 431/45 |
| 4,077,762 | 3/1978 | Matthews | 431/45 |
| 4,082,493 | 4/1978 | Dahlgren | 431/25 |
| 4,086,048 | 4/1978 | Carlson | 431/46 |
| 4,113,419 | 9/1978 | Cade | 431/78 |
| 4,137,428 | 1/1979 | Federico et al. | 179/1 SW |
| 4,140,474 | 2/1979 | Bowles et al. | 431/74 |
| 4,145,180 | 3/1979 | Bendorf | 431/71 |
| 4,188,181 | 2/1980 | Rippelmeyer et al. | 431/73 |
| 4,239,478 | 12/1980 | Tanaka et al. | 431/73 |

*Primary Examiner*—Carroll B. Dority, Jr.
*Attorney, Agent, or Firm*—Finnegan, Henderson, Farabow, Garrett & Dunner

[57] ABSTRACT

A flame detection and proof device utilizing NAND logic implemented by MNOS devices which provides safe control of gas systems and appliances. Improved control is achieved by using a flame probe for providing signals indicative of flame and no-flame conditions connected to circuit means which includes at least one delay circuit for producing a first output signal during a set time period for ignition and also during indication of a flame condition and a second output signal after the set time period and during an indication of no-flame condition. A relay is responsive to the output of the circuit means to be activated during the first output signal and to be deactivated during the second output signal.

12 Claims, 4 Drawing Figures

FLAME DETECTION AND PROOF CONTROL DEVICE

BACKGROUND OF THE INVENTION

The present invention relates to a flame detection and proof control device for detecting flame in a gas-fired system. It finds particular utility in use with a regulated sealed combustion heating system, but can be used in a wide variety of systems and appliances which require safety controls.

It is important for reasons of safety that gas appliances be equipped with a flame detection and control unit which will assure shut-off of gas when no flame is present. The control must also allow for a period for ignition when the gas is on even though there is no flame. When the gas has not been ignited, the system must operate to quickly close the gas valve.

There are a number of types of gas appliances, including heating and air conditioning systems, stoves, dryers, etc., for which such a flame detection and proof device is required. For many years, gas appliances have operated with a pilot light system which ignites the main gas jet when the appliance is turned on. However, in recent years it has been recognized that such systems are not fuel or energy efficient. Consequently, other systems have been introduced to replace the pilot light type of system.

Spark ignition systems have also been used which, in effect, ignite the gas by creating a spark across an ignition gap. These systems are more energy efficient than the pilot light type system, but have not been found to operate well with the regulated sealed combustion heating system.

In recent years flame igniters, usually comprised of silicon carbide, have been developed which can be heated rapidly by applying an AC voltage thereto. The igniters have provided an efficient way of providing ignition of the gas.

Control devices for the above types of ignition systems which have been used in the prior art with gas-fired systems have had certain disadvantages. Relatively high voltage power sources of the order of 220 volts have been required to operate the prior art safety controls. Also, such systems have not always given 100 percent protection in assuring that gas will be shut off if ignition is not effected.

SUMMARY OF THE INVENTION

The present invention overcomes the problems and disadvantages of the prior art by providing a flame detection and proof control device for use in a gas-fired system which comprises a probe for producing first and second signals respectively corresponding to no-flame and flame conditions, a detector circuit, relay means which is responsive to the detector circuit, circuit means including means for delaying the probe output signals a set time period connected to the input of the detector circuit and responsive to the probe output signals, and relay means responsive to the detector circuit to activate only during the set time period or when the probe output signal corresponds to a flame condition. More specifically, circuit means produces a first output signal during the set time period, produces a second output signal after completion of the set time period and during application of the first probe signal and produces the first output signal after completion of the set time period and during application of the second probe signal.

Redundancy is built into the flame detection and proof control device by including substantially duplicate circuits both of which must produce an output signal indicative of safe conditions for activation of the relay.

The flame detection and proof control device also includes a circuit breaker connecting the device to the power source and a control circuit responsive to circuit means to open the breaker when the circuit means produces an output signal indicative of a no-flame condition after the set time period.

This invention utilizes the features of NAND GATE logic implemented by CMOS technology. As a result, high reliability is achieved at low voltage levels.

The accompanying drawings, which are incorporated in and constitute a part of the specification, illustrate one embodiment of the invention and, together with the description, serve to explain the principles of the invention.

DESCRIPTION OF PREFERRED EMBODIMENTS

Reference will now be made in detail to the present preferred embodiment of the invention, an example of which is illustrated in the accompanying drawings.

Figure 1:
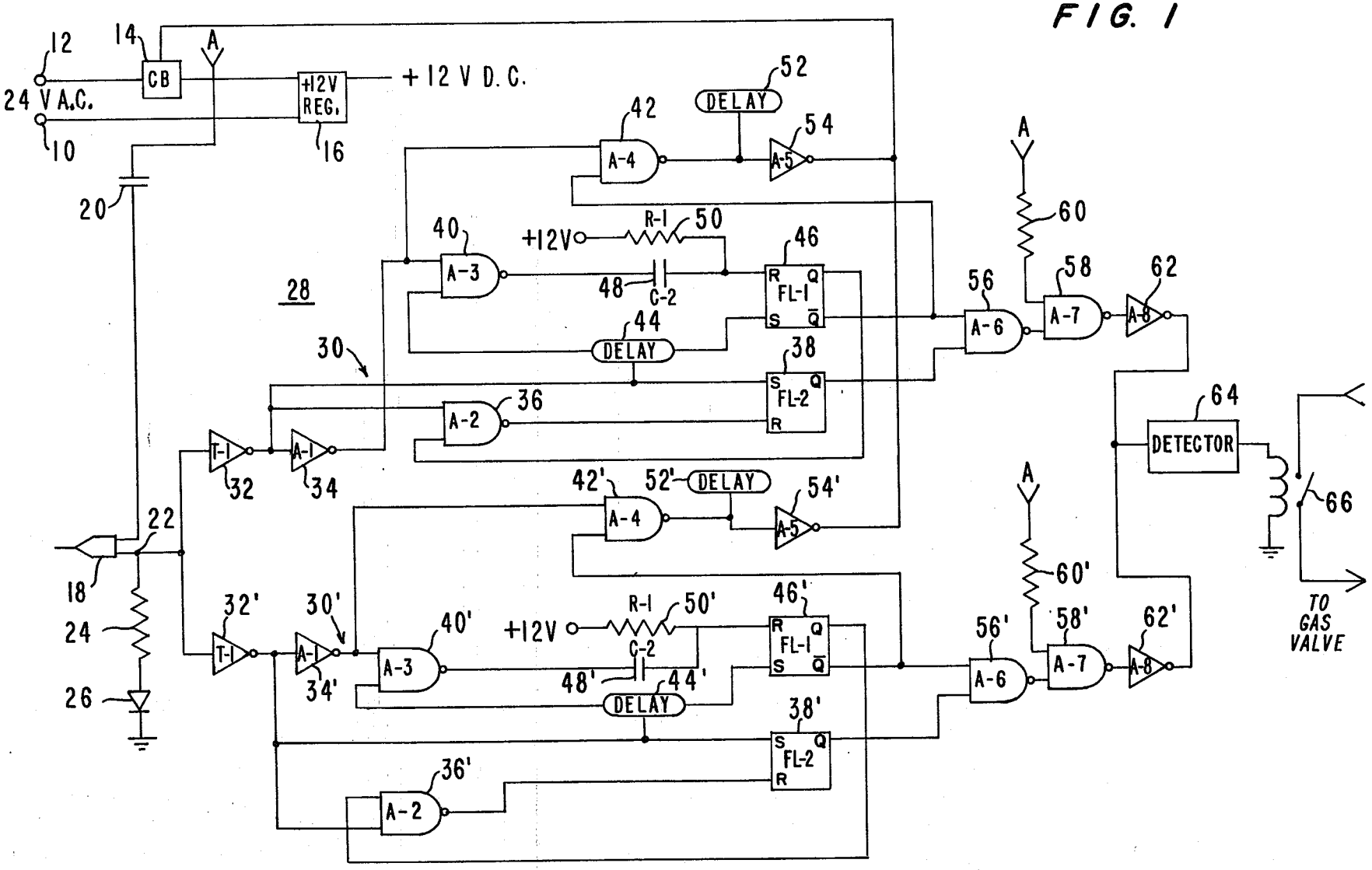
FIG. 1 is a schematic functional diagram of the flame detection and proof control device in accordance with the present invention.

The flame detection and proof control device of the present invention is depicted in the schematic diagram of FIG. 1. The device shown is designed to detect and prove the presence of flame in a gas-fired system. In accordance with the invention, the device operates at low voltages using redundant circuitry to achieve safe dependable control of gas appliances and other systems.

As here embodied, an AC power source is connected across lines 10, 12. In the preferred embodiment, a low voltage 24-volt power source is used. Circuit breaker 14 and regulated DC power source 16 are connected in series with the power source. DC power source 16, for example, typically produces a 12-volt DC output and provides all of the power for the circuitry of the flame detection and proof control device of the present invention.

Probe 18 can be a flame rod, well known in the art, in which current changes as a function of the presence of flame. Each of these types of flame-probes produces first and second signals corresponding respectively to no-flame and flame conditions.

In the preferred embodiment, an AC voltage signal tapped off at point A is applied through capacitor 20 to probe 18. DC terminal 22 may be grounded through resistance 24 and diode 26 for testing purposes. In the absence of flame, the AC input is not rectified and a first probe signal of zero volts is present at terminal 22. In the presence of flame, a second probe signal which is negative is produced by rectifying the AC input.

It is preferred that circuit means 28 comprise substantially identical circuits 30 and 30'. They provide a redundancy which adds to the safety of the flame-proof control device, as will be described below. For convenience, circuit 30 is described below with the understanding that circuit 30' has corresponding elements labeled identically.

As here embodied, inverter 32 is connected with DC terminal 22 of probe 18. The output of inverter 32 is connected to inverter 34, one input of NAND GATE 36 and the set terminal of flip-flop 38. The output of inverter 34 is connected to a first terminal of NAND GATE 40 and to a first terminal of NAND GATE 42.

As here embodied, delay circuit 44, which provides a start delay of a set time period to allow for ignition of the gas, is connected to the second input of NAND GATE 40, to the reset terminal of flip-flop 38 and to the set terminal of flip-flop 46. The time period is set typically at ten seconds to allow sufficient time for ignition of the gas. The timing of delay circuit 44 is initiated by turn-on of the power source.

The output of NAND GATE 40 is connected through capacitor 48 to the reset terminal of flip-flop 46. A 12-volt DC signal also is applied through resistance 50 to the set terminal of flip-flop 46. The second terminal of NAND GATE 36 is connected with the Q terminal of flip-flop 46.

Preferably, a circuit breaker control circuit is provided for opening breaker 14 if no flame is detected after the set time period. As here embodied, the control circuit includes a second delay circuit 52 connected to the output terminal of NAND GATE 42 which is connected to the input of inverter 54. The output of inverter 54 is connected to circuit breaker 14. The timing of delay circuit 52 is initiated by turn-on of the power source.

The respective Q and Q output terminals of flip-flops 46 and 38 are connected to the input terminals of NAND GATE 56, which in turn, has an output connected to NAND GATE 58. The second terminal of NAND GATE 58 is connected through resistance 60 to terminal A to which the AC voltage signal is applied. NAND GATE 58 is connected through amplifier 62 to detector circuit 64. First and second output signals of circuit means 28 are produced at the output of inverter 62.

As here embodied, detector circuit 64 is connected to relay 66.

The operation of the circuit of FIG. 1 will now be described. Upon application of power to terminals 10 and 12, relay 66 is activated, thereby operating on some element of the system such as opening a gas valve (not shown). The present invention will be discussed in terms of controlling the opening and closing of a gas valve, although it will be appreciated that other elements of a system such as a switch could be controlled by the present device.

If an input signal to circuit means 28 derived from probe 18 indicates a flame condition, relay 66 will remain energized holding such gas valve open until power is removed from terminals 10 and 12. If power is removed from the circuit, relay 66 is de-energized and the gas valve closed.

if the input signal derived from flame probe 18 indicates a no-flame condition after the set time period for ignition, relay 66 is deactivated, closing the gas valve and simultaneously the control circuit for circuit breaker 14 trips the breaker. By proper design and sizing of the elements of delay circuit 44 the delay time can be adjusted by typically is approximately 10 seconds. If, after ignition has been accomplished and the relay 66 has been activated beyond the set period of time, for any reason the flame is extinguished, relay 66 will deactivate, closing the gas valve and simultaneously the circuit breaker 14 responsive to the control circuit will open.

Referring to the schematic diagram shown in FIG. 1, the operation of this preferred embodiment can clearly be described. The AC voltage source is applied across lines 10 and 12, and the DC regulated power supply provides power to the circuit. During the set time delay provided by circuit 44 and while there is a no-flame indication at terminal 22 of probe 18, relay 66 is activated and the gas valve is opened. As here embodied, the no-flame signal at terminal 22 is a zero DC voltage. At this time, delay circuit 52 provides a low output on inverter 54 during the set time period for ignition.

Delay circuit 44 preferably assures a low input on the reset terminal of flip-flop 38, the set terminal of flip flop 46 and on one input to NAND GATE 40 during the set time period. During this initial ignition period, an AC voltage signal is applied to probe 18 through capacitor 20. The Q output of flip-flop 46 stays low for the set time period, i.e., approximately 10 seconds in the typical case, and the Q output of flip-flop 38 is locked low during the initial ignition period. Consequently, the output of NAND GATE 56 is high and a first signal output (high) is produced by circuit 30. The high signal is applied to detector 64 and relay 66 remains activated.

If during the ignition period, i.e., during the set time period of approximately 10 seconds set by delay circuit 44, flame is detected by probe 18, a negative voltage will appear at flame probe input 22. This causes the output of inverter 34 to go low and NAND GATE 40 to go high. However, since flip-flop 46 is timing under the control of timing circuit delay 44 there is no effect on the outputs of flip-flop 46. The Q output of flip-flop 46 stays low.

The low voltage at flame probe input 22 also causes the output of inverter 32 to go high, the output of NAND GATE 36 to go low and, as a consequence, the Q output of flip-flop 38 to latch high. Consequently, as long as the flame detection and proof control device detects flame, a first output signal (high) is produced by circuit 30 and relay 66 remains activated.

If after the completion of the set time period, no flame is detected by probe 18, flip-flop 46 will reset and the respective Q output will be high. As a consequence, the output of NAND GATE 56 would be low if the Q output of flip-flop 38 is high, indicating no flame. This causes deactivation of relay 66 and closing of the gas valve. The same action occurs if there was a flame but that flame was subsequently lost.

As here embodied, as long as there is a signal at probe input terminal 22 indicative of the presence of a flame, or flip-flop 46 is still timing responsive to delay circuit 44, a low is on one of the inputs of NAND GATE 42 and its output is high. But after the set time period for ignition is completed and flip-flop 46 is no longer timing, both inputs to NAND GATE 42 will be high if a no-flame condition is detected by probe 18 and zero volts appears at DC terminal 22. Relay 66 would then deactivate. After the set time period of delay circuit 52, the low output of NAND GATE 42 switches the output of inverter 54 high, thereby causing circuit breaker 14 to open. Thus, when there is a no-flame indication after the end of the set time period, relay 66 is deactivated closing the gas valve and circuit breaker 14 opens.

It is preferred that circuit 30, responsive to the probe output signals, produce a first output signal (high) during the set time period, produce a second output signal (low) after the set time period and during application of the first probe signal indicative of a no-flame condition and produce the first output signal (high) after the set time period and during application of the second probe signal indicative of a flame condition. Relay 66 is activated during the set time period to allow time for gas ignition. If for any reason, ignition is not effected during the set time period, relay 66 is deactivated and circuit breaker 14 is opened.

It will be understood that circuit 30' operates in a manner identical to that of circuit 30 and builds a safety redundancy into the flame detection and proof control device. The first output signal (high) must appear at the respective outputs of circuits 30 and 30' to activate relay 66 through detector circuit 64. Otherwise, it is deactivated and the associated gas valve is closed providing complete and safe operation.

Figure 2A:
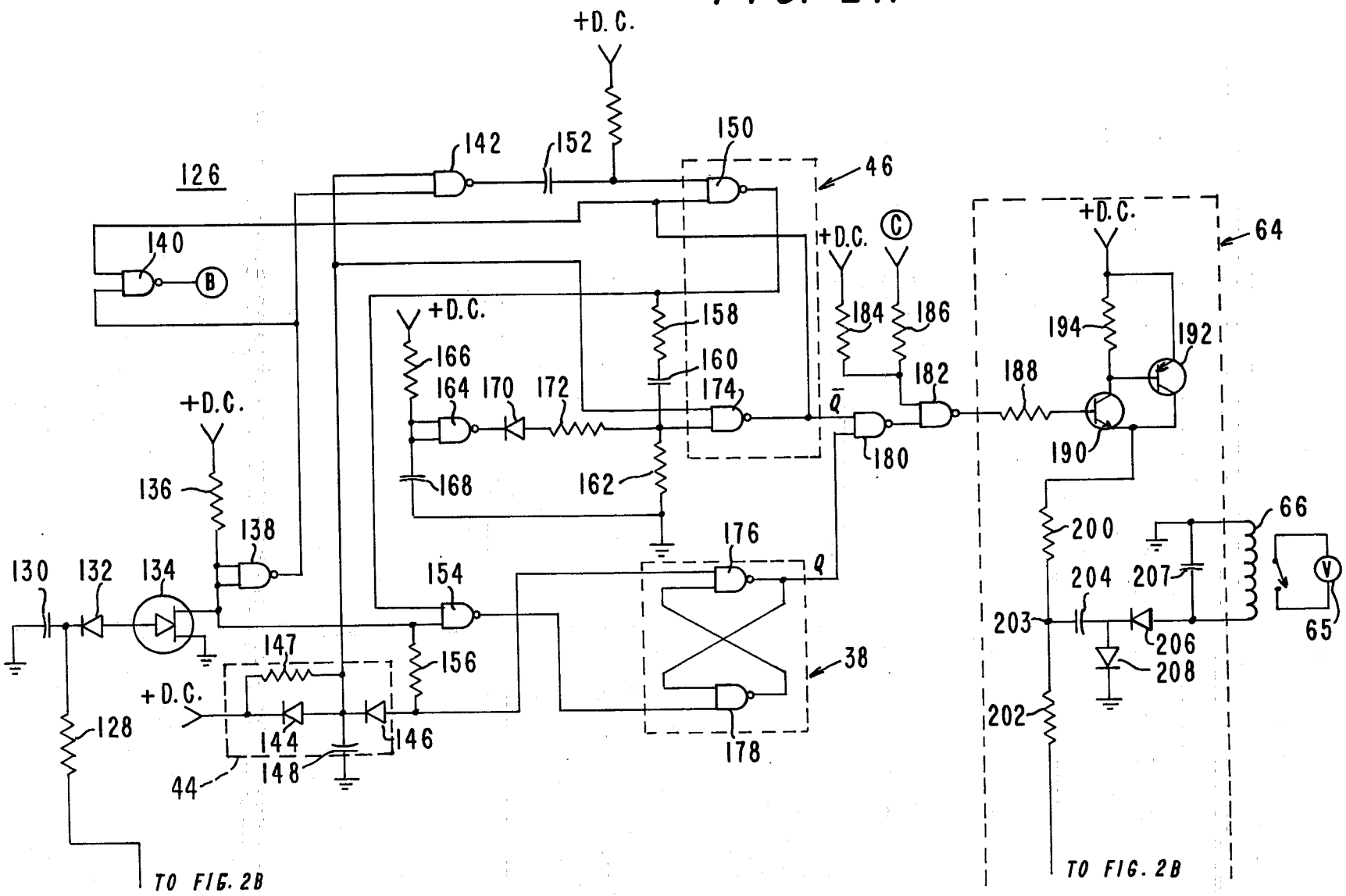
FIGS. 2A, 2B and 2C are portions of a single circuit diagram of the preferred embodiment of the present invention.
Figure 2B:
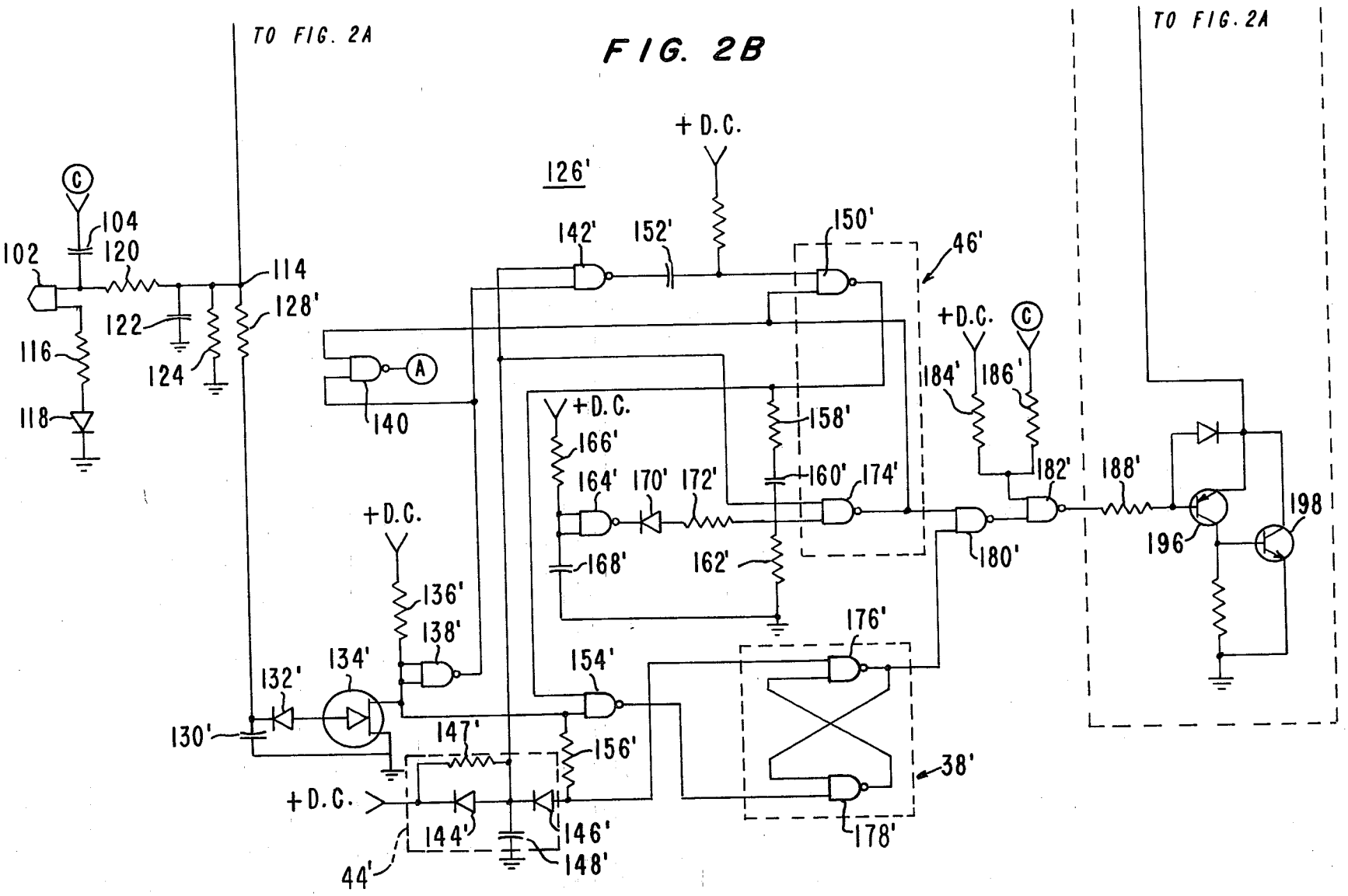
Figure 2C:
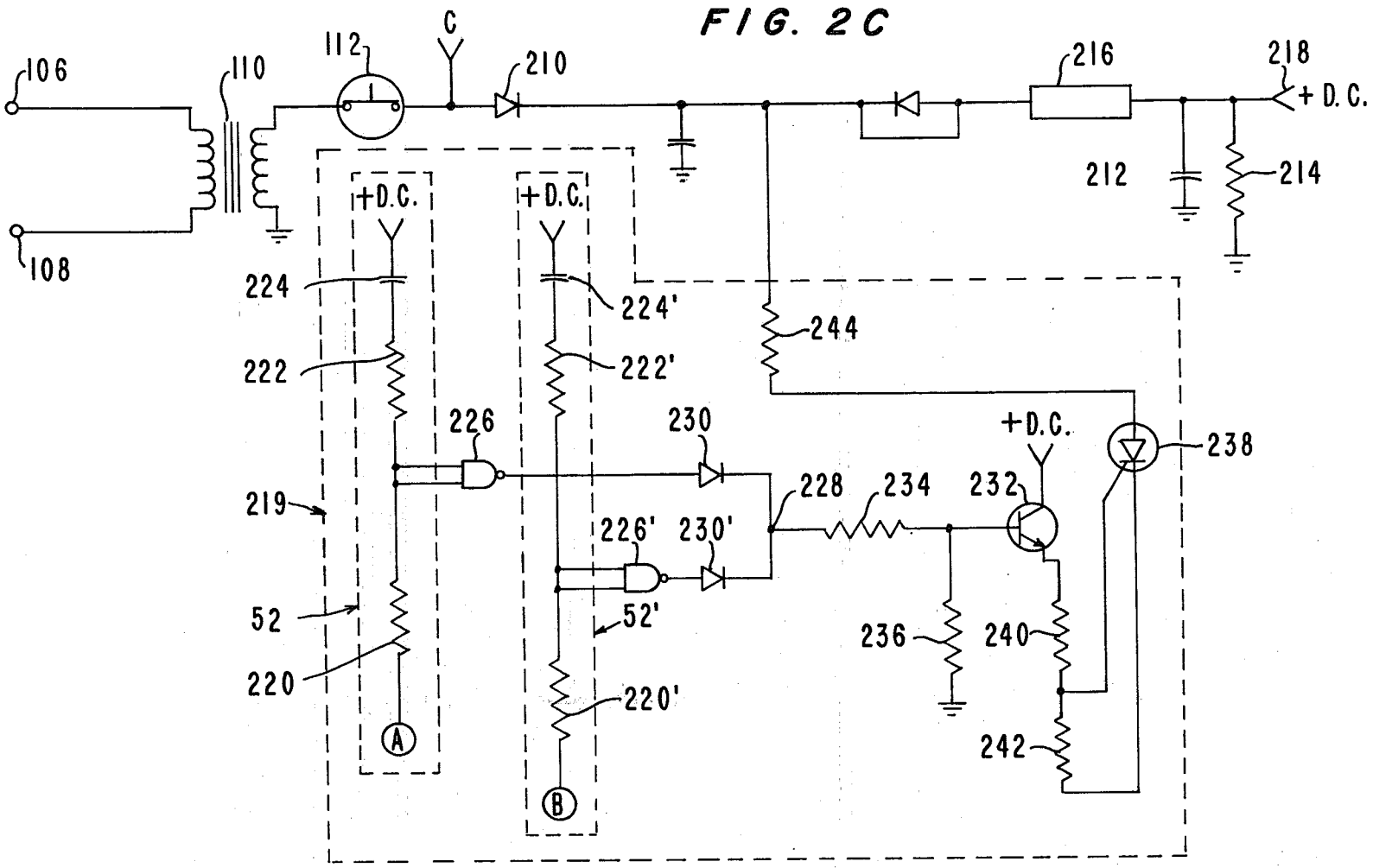

Reference is now made to FIGS. 2A and 2B which show a circuit diagram of the preferred embodiment. It is to be understood that circuit connections are made between FIGS. 2A and 2B at those terminals labeled A, B, and C. It should further be understood that the circuit diagram of FIGS. 2A and 2B implement the functional block diagram of FIG. 1.

It is preferred that flame probe 102 be connected to the AC power source through capacitance 104. AC power is applied across lines 106 and 108 through transformer 110 and circuit breaker 112. The AC voltage signal is taken off at point C (FIG. 2B) and applied to flame probe 102 through capacitance 104.

As here embodied, probe 102 produces first and second signals corresponding respectively to no-flame and flame conditions at terminal 114. Probe 102 may be grounded through resistance 116 and diode 118 for testing purposes, if desired. The DC terminal 114 is connected to probe 102 through resistance 120 with capacitance 122 and resistance 124 connected to ground.

As here embodied, circuit means is comprised of substantially duplicate circuits 126 and 126'. Such duplicate circuitry builds in redundancy to the circuit. For purposes of description, circuit 126 is described below.

Terminal 114 is connected to resistance 128. The other end of resistance 128 is connected to grounded capacitance 130 and diode 132. Diode 132 is connected through JFET 134 to resistance 136 and NAND GATE 138. It is preferred that NAND GATE 138 and the other NAND GATES included in the circuit means be implemented by CMOS devices such as the Motorola MC14011. NAND GATE 138 functions as an inverter. NAND GATE 138 is connected to the respective first terminals of NAND GATES 140 and 142. The second input terminal of NAND GATE 142 is connected to the junction of diodes 144 and 146 and capacitance 148. The second input terminal of NAND GATE 140 is connected to an input terminal of NAND GATE 150 of flip-flop 46. The output of NAND GATE 140 is connected at junction B of FIG. 2B. The second input terminal of NAND GATE 150 is connected through capacitance 152 to the output terminal of NAND GATE 142.

As here embodied, the output of JFET 134 is also connected to an input terminal of NAND GATE 154 and resistance 156. The second input terminal of NAND GATE 154 is connected to output terminal of NAND GATE 150 and to a terminal of delay circuit 44. Delay circuit 44 is comprised of serially connected resistance 158, capacitance 160 and resistance 162.

The output of NAND GATE 154 is connected to the reset terminal of flip-flop 38. Both terminals of NAND GATE 164 are connected through resistance 166 to the DC voltage source and through capacitance 168 to ground. The output of NAND GATE 164 is connected to delay circuit 44 through diode 170 and resistor 172. As here embodied, delay circuit 44 is comprised of resistances 158 and 162 and capacitance 160.

Flip-flop 46 is comprised of NAND GATES 150 and 174. Flip-flop 38 is comprised of NAND GATES 176 and 178. Each of these flip-flops is connected in a conventional manner. The respective Q terminal of flip-flop 38 and Q terminal of flip-flop 46 are connected to the inputs of NAND GATE 180. The output of NAND GATE 180 is connected to one terminal of NAND GATE 182, the other input terminal of which is connected through resistance 184 to the DC source and through resistance 186 to the AC signal at junction C on FIG. 2B.

The output of the circuit means comprised of circuits 126 and 126' are respectively taken at the outputs of NAND GATES 182 and 182'. These respective outputs are applied to detector circuit 64. As here embodied, detector circuit 64 is comprised of resistance 188 connected to transistor 190. Transistors 190 and 192 are connected in a current amplifier arrangement to amplify the current signal received from NAND GATE 182. Likewise, transistors 196 and 198 connected through resistance 188' to the output of NAND GATE 182' are connected in an inverted manner to act also as current amplifiers for current from NAND GATE 182'. Resistances 200 and 202 limit current to protect the respective transistors. The junction of resistances 200 and 202 is connected to the output of detector circuit 64 through capacitance 204 and diode 206 to relay 66.

The redundant circuit 126' in FIG. 2B performs in the same manner as does the previously-described circuit 126 seen in FIG. 2A. Furthermore, each primed element in circuit 126' operates as its unprimed counterpart does in circuit 126.

Accordingly, the output of probe 102 at terminal 114 is connected to JFET 134' by resistor 128' and diode 132'. Capacitor 130' connects between the cathode of diode 132' and ground. The source of JFET 134' is connected to +D.C. by resistor 136' and provides both inputs to NAND gate 138'. The source of JFET 134' is also an input to NAND gate 154', that input also being connected by resistor 156' to delay circuit 44'.

Delay circuit 44' comprises diodes 146' and 144' connected in series, with the cathode of diode 144' connected to +D.C. Delay circuit 44' also includes resistor 147', which shunts diode 144', and capacitor 148' which connects between ground and the junction of diodes 144' and 146'.

The other input of NAND gate 154' is an output from flip-flop 46'. The output of NAND gate 154' is connected to the reset terminal of flip-flop 38', the set input of flip-flop 46' is connected to the anode of diode 146' in delay circuit 44'. Flip-flop 38' comprises cross-coupled NAND gates 176' and 178'.

The output of NAND gate 138' referred to above, provides one input to NAND gate 142', the other input being the signal at the junction of diodes 144' and 146' in delay circuit 44'. The output of NAND gate 142' is connected through capacitor 152' and a pullup resistor to the reset input of flip-flop 46'.

Flip-flop 46' comprises NAND gates 150' and 174'. The output of NAND gate 150' is, as mentioned above, an input to NAND gate 154'. The output of NAND gate 150' is also connected to ground through a series circuit comprising resistor 158', capacitor 160', and resistor 162'.

One input of NAND gate 174' in flip-flop 46' is the signal at the junction of diodes 144' and 146' in delay circuit 44'. The other input is the signal at the output of NAND gate 164' after it passes through diode 170' and resistor 172'. The inputs of NAND gate 164' are connected to +D.C. through resistor 166' and to ground through capacitor 168'.

The Q output of flip-flop 46' and the Q output of flip-flop 38', or the outputs of NAND gates 174' and 176', respectively, are the inputs to NAND gate 180'. The output of NAND gate 180' is one input to NAND gate 182', whose other input is a node connected through resistor 184' to +D.C. and through resistor 186' to terminal C.

Referring now to the circuit portion shown in FIG. 2B, the power supply for the electronic circuit of this invention consists of diode 210, capacitor 212, resistance 214 and integrated circuit voltage regulator 216. The DC voltage, typically at 12 volts DC, is taken off at terminal 218 to be applied to the circuit where indicated.

As here embodied, the circuit breaker control circuit 219 controls the tripping of breaker 112. Delay circuits 52 and 52' are respectively comprised of serially connected resistances 220 and 222 and capacitance 224 and resistances 220' and 222' and capacitance 224'. The respective delay circuits 52 and 52' are connected to NAND GATES 226 and 226'. The outputs of NAND GATES 226 and 226' are respectively connected to terminal 228 through diodes 230 and 230'. Transistor 232, connected at terminal 228 through resistance 234, acts as a switch to trigger SCR 238. The emitter of transistor 232 is connected to resistance 240, whose second end is connected to the gate of SCR 238 and to resistance 242. The anode of SCR 238 is connected to resistance 244.

The operation of the circuit of FIGS. 2A and 2B is described below. DC voltage is applied to the circuit by the regulated source 216. Resistance 147 and capacitance 148 provide a very short time delay. Capacitance 148 holds the inputs of NAND GATES 142, 174 and 176 low during turn-on in order to assure positive outputs. After capacitance 148 charges, it triggers the input of NAND GATE 142, starting the timing sequence. Resistance 162 normally keeps the input at NAND GATE 174 low. Upon triggering, the output of NAND GATE 150 goes high and the high is applied to the input of NAND GATE 174 through resistance 158 and capacitance 160 and resistance 162. A high output of NAND GATE 176 is assured by a low on the input of NAND GATE 176 and a high on the input of NAND GATE 178 until a flame is detected and input to NAND GATE 178 goes low. Then NAND GATE 176 will switch low and stay low as long as the flame is detected.

The output of NAND GATE 140 cannot go low during the timing of the set time period or in the presence of a low signal input indicating the presence of flame. During the set time period and before flame detection, the input to NAND GATE 180 is held low by the output of flip-flop 46 which, in turn, keeps the output of NAND GATE 180 high. This allows the AC signal to control operation of NAND GATE 182.

NAND GATE 164 acts as a timer. The inputs are held low when supply voltage is applied and the output is held high for the set time period, typically ten seconds. The set time period is determined by the values of the elements of delay circuit 44. Diode 170 blocks this high from the input of NAND GATE 174. After the set time period, the output of NAND GATE 164 goes low, shunting resistance 162 with resistance 172 and creating a drop-out time of approximately 3 seconds, dependent on circuit element values, should a loss of flame detection occur.

As here embodied, the detector circuit 64 comprises transistors 180 and 192 connected in a current amplifier arrangement to amplify current from NAND GATE 182. Transistors 196 and 198 are similarly connected, only in an inverted arrangement. The resistances 200 and 202 limit current to protect the respective transistors. When both transistor arrangements are conductive, a first signal (high) is generated at junction 203. If either or both transistor arrangements are nonconductive, a second signal (low) is generated at junction 203. Capacitance 204 couples the amplified current to a voltage doubler comprised of diodes 206 and 208 which is filtered by capacitance 207. The voltage across capacitance 207 activates relay 66 upon turn-on of the supply voltage.

If a flame is detected during the set time period, a negative voltage is applied to the gate of JFET 134 causing it to stop conducting. Input to NAND GATES 154 and 176 then go positive. The output of NAND GATE 154 goes low setting the output of flip-flop 38 low. This assures a continued high on the output of NAND GATE 180 as long as flame is present and power is supplied.

It will be apparent to those skilled in the art that various modifications and variations could be made in the invention without departing from the scope or spirit of the invention.

What is claimed is:

1. A control device for use in a gas-fired system connected to a power source, said control device comprising:

a probe indicating the presence of a flame in said gas-fired system;

circuit means connected to said probe and including two flip-flops, a first flip-flop indicating the presence of an ignition period and a second flip-flop indicating the presence of a flame in said gas-fired system, said circuit means producing a first output signal when said flip-flops are indicating the presence of either an ignition period or a flame, and producing a second output signal at all other times;

a gas valve; and relay means operatively connected to said gas valve and used to control the supply of gas in said gas-fired system, said relay means being connected to said circuit means and only being activated by said first output signal.

2. The control device of claim 1 wherein said probe is a flame rod in which current through said flame rod is a function of a flame or no-flame condition.

3. The control device of claim 1 further including circuit breaker means connecting said device to said power source and a control circuit responsive to said circuit means to open said breaker when said circuit means produces said second output signal.

4. The control device of claim 1 wherein said circuit means includes at least one emitter follower transistor circuit which is conductive when said first output signal is produced by said circuit means.

5. The control device of claim 1 further including a gas valve responsive to said relay means, open during the first output signal of said circuit means and closed during the second output signal of said circuit means.

6. The control device of claim 1 wherein said circuit means includes a first circuit and a second circuit each of which includes a first flip-flop indicating the presence of an ignition period and a second flip-flop indicating the presence of a flame in said gas-fired system, each of said circuit means producing a first output signal when said flip-flops are indicating the presence of either an ignition period or a flame, and producing a second output signal at all other times; and wherein said device includes a detector means between said circuit means and said relay means, said detector means activating said relay means when either said first circuit or said second circuit produces a first output signal.

7. The control device of claim 6 wherein said detector circuit activates said relay means only when both said first and second circuits produce the first output signal.

8. The control device of claim 1 wherein said circuit means is comprised of CMOS logic elements.

9. A flame detection and proof control device for use in a gas-fired system operable with a power source, comprising:

a probe for producing an output indicative of no-flame or flame, circuit means responsive to the output of said probe having a plurality of NAND GATES, a delay circuit for delaying signals a set time period after turn-on of said power source and at least one flip-flop responsive to said NAND GATES and delay circuit to latch the output of said circuit means at one signal level only after the set time period is completed and the probe signal output is indicative of no-flame, said circuit means also including a first circuit and a second circuit each of which respectively produces a first output signal during said set time period, a second output signal after said set time period and during a probe output indicative of no-flame, and produces said first output signal after said set time period and during a probe output indicative of flame;

means for detecting the output of said circuit means; and relay means activated by said detecting means only when both said first and second circuits produce said first output signal.

10. The flame detection and proof control device of claim 8 further including a circuit breaker connected in series with said power source and a control circuit responsive to said output of said circuit means to open said circuit breaker when said output of the circuit means is at said one signal level.

11. A control device for use in a gas-fired system connected to a power source, said control device comprising:

a probe indicating the presence of a flame in said gas-fired system;

circuit means connected to said probe and including two flip-flops, a first flip-flop indicating the presence of an ignition period and a second flip-flop indicating the presence of a flame in said gas-fired system, said circuit means producing a first output signal when said flip-flops are indicating the presence of either an ignition period or a flame, and producing a second output signal at all other times;

relay means used to control the supply of gas in said gas-fired system, said relay means being connected to said circuit means and only being activated by said first output signal;

circuit breaker means connecting said device to said power source; p1 a control circuit responsive to said circuit means to open said circuit breaker means when said circuit means produces said second output signal; and a first delay circuit connected to the control circuit of said circuit breaker means for holding said circuit breaker means closed during a set time period.

12. The device of claim 11 further including a second delay circuit for setting the time period of the control circuit for said circuit breaker means.

* * * * *